US005647099A

United States Patent [19]

Cohen

[11] Patent Number: 5,647,099

[45] Date of Patent: Jul. 15, 1997

[54] GARMENT PIN

[76] Inventor: Eric S. Cohen, 11111 Biscayne Blvd., Apt. 615, Miami, Fla. 33161

[21] Appl. No.: 538,969

[22] Filed: Oct. 5, 1995

[51] Int. Cl.[6] ..... A44B 21/00; A44C 3/00

[52] U.S. Cl. ..... 24/3.3; 40/1.5

[58] Field of Search ..... 248/904; 63/1.1; 24/3.3, 3.7, 3.8, 13; 224/182, 230, 904; 40/1.5

[56] References Cited

U.S. PATENT DOCUMENTS

| | | | |
|---|---|---|---|
| 3,810,321 | 5/1974 | Kiba | 40/1.5 |
| 3,953,910 | 5/1976 | Farb | 40/1.5 X |
| 3,956,795 | 5/1976 | Kosakai | 24/3.3 |
| 4,458,384 | 7/1984 | Arnold | 24/3.3 |
| 4,524,892 | 6/1985 | Ozeki | 224/256 |
| 5,033,612 | 7/1991 | Bivins | 24/3.3 X |
| 5,129,617 | 7/1992 | MacWilliamson | 24/3.3 X |
| 5,319,838 | 6/1994 | Eppenauer | 24/3.3 |

*Primary Examiner*—Peter M. Cuomo
*Assistant Examiner*—Robert J. Sandy
*Attorney, Agent, or Firm*—Kirschstein, et al.

[57] ABSTRACT

A garment pin for supporting a pair of eyeglasses at a predetermined location of an outer garment of a user includes a holding member capable of being detachably secured to the outer garment, and a support member operative for supporting the eyeglasses on the holding member in a suspended position. The support member is loop-shaped and extends along a course including a pair of substantially straight end sections diverging from one another in the upward direction, and an intermediate section integrally merging with the diverging end sections and including a substantially centrally situated arcuate connecting section of a radius of curvature large enough for the eyeglasses, which extend through and embrace the loop-shaped support member in its suspended position, to be able to slide along the connecting section until reaching a respective one of a pair of transition sections of the support member that flank the connecting section and at which the radius of curvature changes to an appreciable extent.

10 Claims, 2 Drawing Sheets

FIG. 1
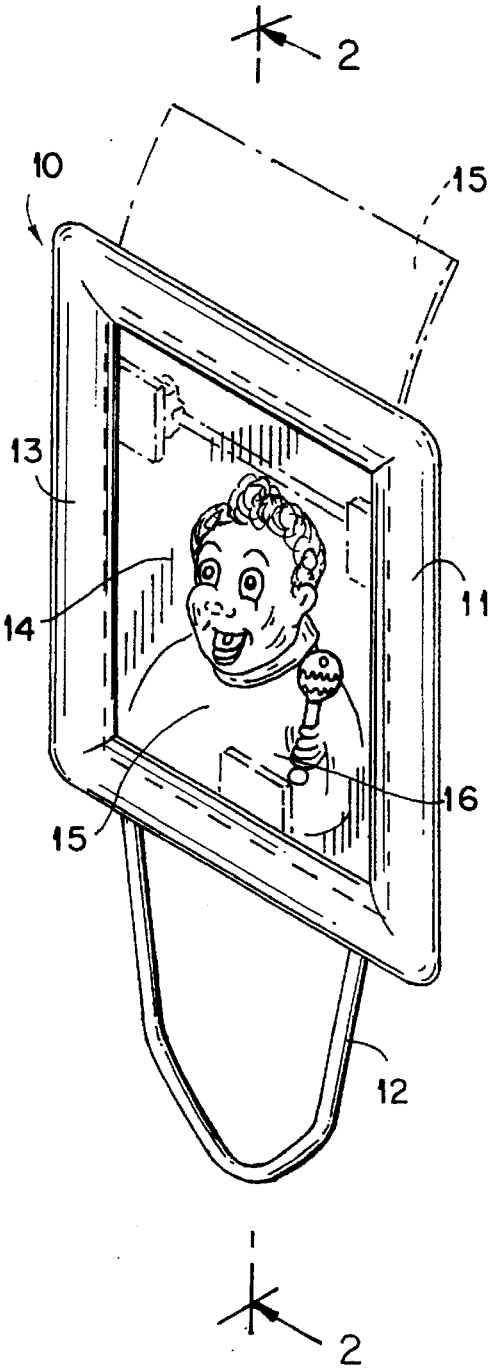
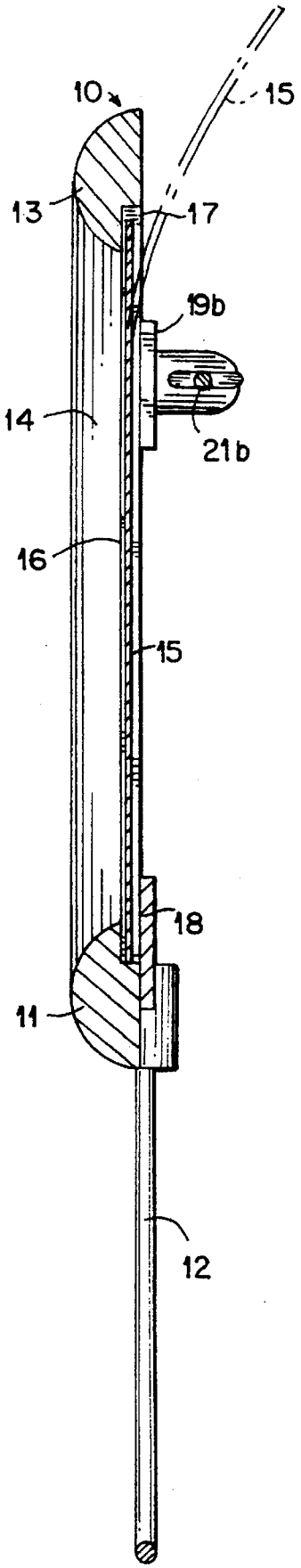
FIG. 2

GARMENT PIN

BACKGROUND OF THE INVENTION.

1. Field of the Invention

The present invention relates to decorative articles in general, and more particularly to an article of that kind which is designed to both display an object to be exhibited and support another object on a predetermined region of an outer garment of a user thereof.

1. Description of the Related Art

There are already known various constructions of decorative articles to be worn by respective users, among them such that are constructed to be attached to a selected region of a piece of outer garment worn by a user. Brooches and tie pins fall into this category.

In this context, it is already known to construct the respective article as a holding member that simply holds a separate object to be displayed, in its display position on the outer garment of the user. This object may be, for instance, a photograph of a person so dear to the user of the decorative article that he or she wishes to display it to other people at all times. On the other hand, it is also known to use a decorative article, possibly of a different kind than that discussed above, as a temporary support for another object, especially a pair of eyeglasses, be it prescription eyeglasses or sunglasses, at a convenient location on the outer garment of the user.

However, experience with the latter type of decorative article has shown that, because the aforementioned convenient location is usually situated on a part of the body, typically the torso, of the user that conducts periodic movements as the user walks, for instance, there is a high probability that the pair of eyeglasses that is suspended from the decorative article may get into uncontrolled sympathetic swinging motion in response to such body movements of the user. This, of course, is not only highly inconvenient because such excessive movements are perceived as being unpleasant by the user whereas movements of lesser magnitude would not be, but also could be dangerous because such excessive and violent swings of the eyeglasses could occasionally result in the eyeglasses dissociating themselves from the holding member and falling to the ground or other hard surface with the high probability that they would be damaged as a result of such fall.

OBJECTS OF THE INVENTION

Accordingly, it is a general object of the present invention to avoid the disadvantages of the prior art.

More particularly, it is an object of the present invention to provide a decorative article to be worn on an outer garment of the user and to support at least one other item thereon, which article does not possess the drawbacks of the known decorative articles of this kind.

Still another object of the present invention is to devise a decorative article of the type here under consideration which is particularly suited to serve as a temporary support for a pair of eyeglasses while not being used.

It is yet another object of the present invention to design the above decorative article in such a manner as to limit the extent of swinging of the eyeglasses supported in a pending fashion on the article in response to periodic bodily movements of the user.

A concomitant object of the present invention is so to construct the decorative article of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a garment pin for supporting a pair of eyeglasses at a predetermined location of an outer garment of a user. The decorative article includes a holding member; means for detachably securing the holding member to the outer garment at its predetermined location and having an upper and a lower region as considered in a use position of the holding member; and means for supporting the eyeglasses in a suspended position thereof on the holding member.

According to the present invention, such supporting means includes a loop-shaped support member secured to the holding member at the lower region thereof and extending downwardly from the holding member as considered in the use position. The support member follows a course including a pair of substantially straight end sections diverging from one another in the upward direction, and an intermediate section integrally merging with the diverging end sections and including a substantially centrally situated arcuate connecting section. This arcuate connecting section has a radius of curvature that is large enough for the eyeglasses, which extend through and embrace the loop-shaped support member in the suspended position thereof, to be able to slide along the connecting section until reaching a respective one of a pair of transition sections of the support member that flank the connecting section and at which the radius of curvature changes to an appreciable extent.

A particular advantage of the decorative article construction as described so far is that the extent of any swinging motion of the eyeglasses while being suspended from the decorative article is limited as a direct result of the sudden change in the radius of curvature of the loop-shaped support member.

Advantageously, each of the transition sections is substantially straight but exhibits a lesser slope than the respective adjacent one of the end sections as considered in the use position of the holding member. The support member advantageously has a substantially wire-shaped configuration. It is further desirable when the support member is separate from the holding member, and when the holding member includes a pair of protuberances at its lower region, each substantially tightly embracing an associated one of the diverging end sections of the support member.

According to another advantageous aspect of the present invention, the holding member includes a substantially frame-shaped structure bounding a display window, and means at the back of the holding member as considered in its use position for maintaining an object to be displayed through the window in its display position on the holding member. It is particularly desirable when such object is substantially sheet-shaped, such as a photograph, and when it includes a circumferentialy extending marginal portion. Under these circumstances, the frame-shaped structure advantageously includes a circumferentially extending recess for receiving the marginal portion of the object in its display position.

In accordance with another advantageous facet of the present invention, the aforementioned maintaining means includes a plurality of substantially plate-shaped sections each rigid with the frame-shaped structure of the holding member and engaging the object in its display position to confine the object between itself and the frame-shaped structure. Last but not least, the plate-shaped sections include a first section that is located substantially centrally on the frame-like structure at the lower region of the holding member, and a pair of second sections disposed on the frame-shaped structure at respective lateral regions of the holding member as considered in its use position. Then, the securing means advantageously includes a safety-pin-like securing structure including two components each mounted on one of the plate-shaped second sections and engaging the respective other one of the two components in a closed condition of the securing structure.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG, 1 is a perspective view from the front of a garment pin of the present invention;

FIG. 2 is a sectional view taken in a plane indicated by arrows 2—2 in FIG. 1, at a substantially enlarged scale;

DETAILED DESCRIPTION OF THE PREFERRED EMBODIMENT

Figure 3:
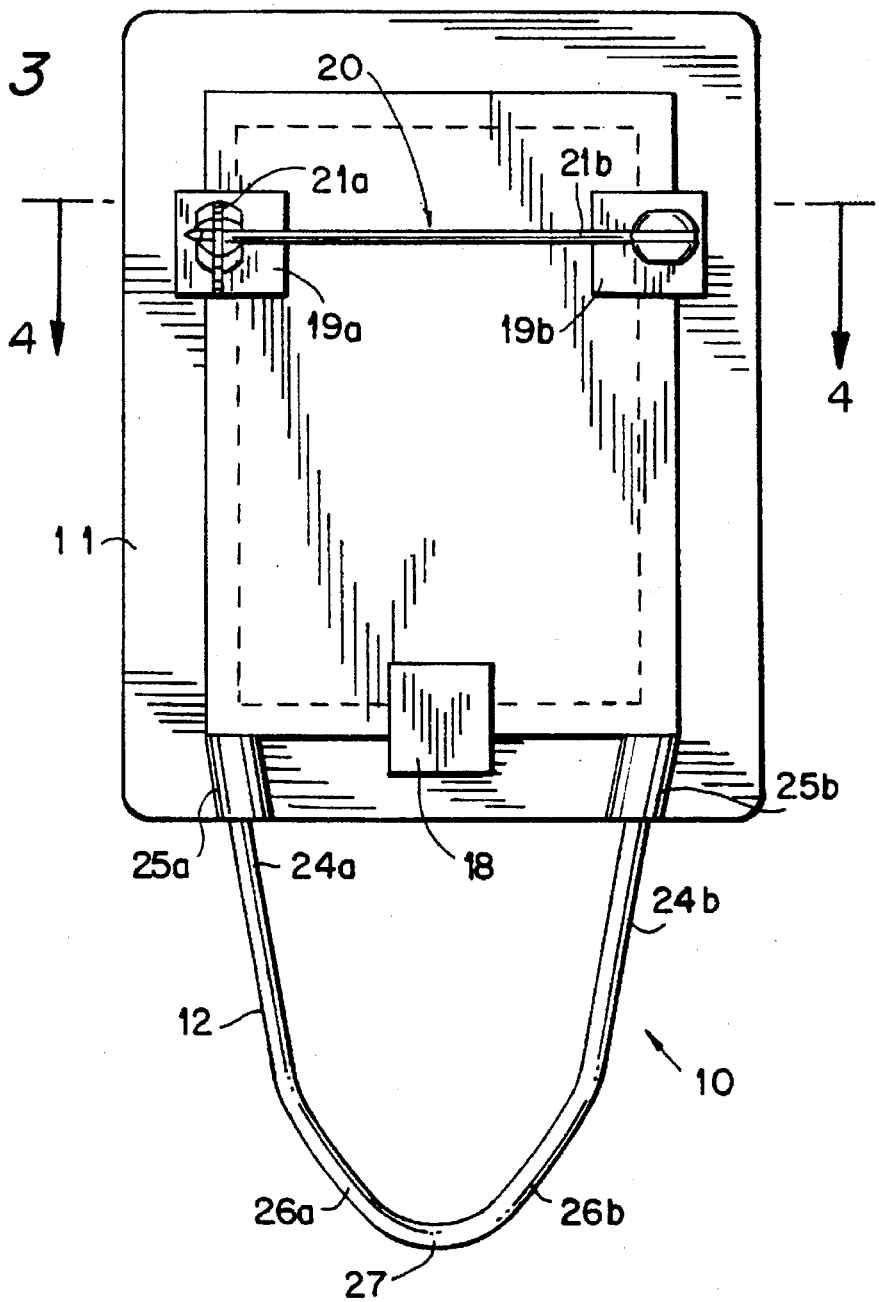
FIG. 3 is a rear elevational view of the garment pin of the present invention, at a scale only slightly exceeding that of FIG. 1.

Referring now to the drawing in detail, and first to FIG. 1 thereof, it may be seen that the reference numeral 10 has been used therein to identify a garment pin of the present invention, in its entirety. The garment pin 10 is intended to be attached to and worn on a piece of garment, such as on a lady's dress or on the lapel of a man's jacket, for instance; hence, its name.

The garment pin 10 includes, as its main components, a holding member 11 and a support member 12 that is securely connected to the holding member 11 in any known manner. The holding member 11 includes a frame-like structure 13 that bounds an opening or window 14 through which an object 15 that is held in or on the holding member 11, especially a photograph carrying an image 16, can be observed when the garment pin 10 is viewed from the front. In this connection, it is to be mentioned that all references that are being made herein to directions, relative positions and/or orientation refer to the position shown in FIG. 1 of the drawing which coincides with that in which the garment pin 10 is worn on a garment when in use.

Thus, in this display condition, the object or photograph 15, framed by the structure 13, is displayed to people who may come close to the wearer of the garment pin 10, be they casual passersby, acquaintances, friends or family members with respect to the wearer of the garment pin 10. This combination provides a great conversation starter because even people who are at most casual acquaintances of the wearer, such as store clerks, bank tellers and the like, are likely to strike up a conversation with the garment pin wearer relating to the pin 10 itself or the image 16 and/or the object 15 displayed in the window 14 of the frame-like structure 13.

Inasmuch as that image 16 is usually a likeness of somebody dear to the wearer of the garment pin 10, any comments made by such people with respect to the image 16 appearing in the window 14, be they polite questions and similar expressions of curiosity, or laudatory remarks directed to the pin 10 itself or, even more likely, to the image 16, will give the wearer an opportunity not only to respond but also engage in continuing conversation on that subject or even venture into other areas, for as long as he or she wishes and/or can hold the attention of the listener.

Of course, rather than the image 16 depicting the likeness of a person, the image can be of a fanciful character, or any artwork, or for that matter, any alphabetic and/or numeric message, particularly an advertisement for a product or service, or a slogan, typically an amusing or shocking one intended to draw attention.

As particularly a comparison of FIGS. 2 and 3 with one another will reveal, the frame-like structure 13 is provided with a circumferentially extending recess 17 intended to receive the marginal region of the substantially sheet-shaped object 15 which, as mentioned before, is preferably a photograph of a loved one. FIG. 2 of the drawing depicts that the sheet-shaped object 15 is received in the recess 17 in a substantially fitting manner, that is with only a small amount of leeway. Of course, it may sometimes if not always be necessary to trim the photograph 15 to the proper size before it fits into the recess 17 in the manner shown.

It goes without saying that the object 15 should be held in the recess 17 against accidentally falling out. To this end, there are provided, in the illustrated embodiment of the present invention, three plate-shaped projections 18, **19*a* and 19*b* that are secured to, and advantageously even of one piece or integral with, the frame-like structure 13. If, however, the projections 18, 19*a* and 19*b* are separate and distinct from the frame-like structure 13, as indicated in the drawing, they are securely connected to the structure 13** in any known manner, such as being adhesively bonded or thermally welded thereto.

The aforementioned projections 18, **19*a* and 19*b* extend inwardly from the frame-like structure 13 at the bottom center and upper lateral regions of the latter, as shown particularly in FIG. 3 of the drawing so that they partially convert the open recess 17 at their respective regions into a channel that is bounded on three of its four sides as viewed in cross section, leaving just one of these sides open for the passage of the object 15 therethrough. The so-to-speak three-point distribution of the projections 18, 19*a* and 19*b* at strategically chosen locations of the recess 17 provides for sufficiently reliable retention of the object 15 in its proper position within the frame-like structure 13 without creating unnecessary redundancy, while simultaneously facilitating the introduction of the sheet-like object 15 into, or its withdrawal from, the recess 17 in a manner indicated in broken lines in FIGS. 1 and 2 of the drawing, by reducing the friction or other motion-inhibiting effects interfering with the free movement of the object 15** into or out of its proper position in the frame-like structure to a minimum.

Figure 4:
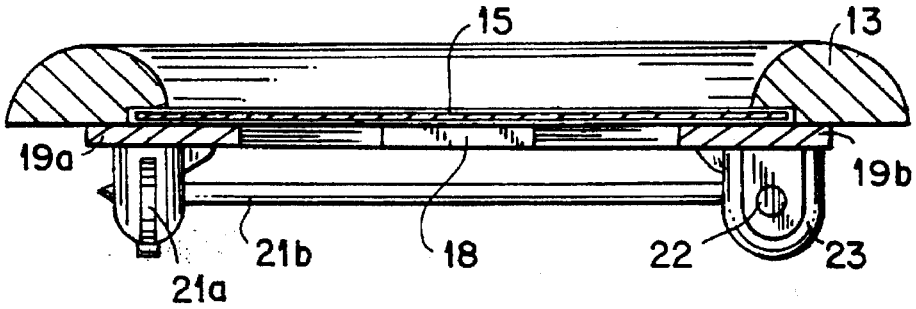
FIG. 4 is a cross-sectional view taken on line 4—4 of FIG. 3.

As shown in FIGS. 3 and 4 of the drawing, especially when considered in conjunction with one another, the projections **19*a* and 19*b* also serve as platforms for supporting a connecting "safety" pin 20, and more particularly two separate but cooperating components 21*a* and 21*b*. The component 21*a* is constructed, in accordance with well established principles known to those with even a passing acquaintance with the fastener or costume jewelry fields, as a hook-shaped member secured to the platform 19*a* and via the same to the frame-like structure 13, while the component 21b essentially consists, as to its basic construction, of an elongated resiliently yieldable member or spring pin which is also connected, in any known manner, to the frame-like structure 13, but this time through the intermediary of the platform 19b**.

In the illustrated implementation of the present invention, the elongated member or pin 20 is wound or otherwise trained about a pivot pin 22 which, in turn, is supported on the platform 19b by a post 23 which is preferably bifurcated, embracing that end portion of the pin 21b that surrounds the pin 22. As is well known, when the safety pin 20 is closed, the tip of the respective other end portion of the elongated member 21b passes through, and terminates at most just a relatively short distance beyond, the hook-shaped member 21a, while it can be disengaged from the hook 21a by simply moving it sideways until it passes fully through an open mouth of the hook-shaped member 21a and is released to assume its natural state in which the safety pin 20 is open and can be removed from or connected to the aforementioned article of clothing or garment.

The device or garment pin 10 to the extent that it has been described so far by more than a passing reference, is intended to be used as means for holding the object 15 in a display position on the selected zone of the garment worn (or to be eventually worn) by the user or owner of the pin 10. However, as disclosed here, the garment pin 10 is intended to perform another function as well, namely that of serving as a convenient and handy support for supporting another item in the possession of the user, especially a pair of glasses, on the aforementioned selected zone of the garment worn or to be worn by the user. For this purpose, the garment pin is equipped with the aforementioned support member 12. The support member 12 is of a cylindrical stock that resembles wire and hence will be referred to as such, regardless of whether or not it is of a metallic material.

As illustrated with highest degree of clarity in FIG. 3 of the drawing, the support member 12 extends along a course that is somewhere between that of the letter U and that of the letter V. As a result, respective end portions 24a and 24b of the wire 12 diverge from one another as considered in an upward direction toward the holding member 11 in the assembled condition of the garment pin 10, and are received in respective holes (not illustrated) provided in respective protuberances 25a and 25b that are provided at lateral regions of the frame-like structure 13 just below the window 14 as considered in the position the garment pin 10 assumes in FIG. 3 of the drawing.

The end portions 24a and 24b are held in position in the protuberances 25a and 25b either as a result of being embedded therein, for example, by being cast or molded therewith, or because of their diverging orientations which, in effect, creates an interference fit between these end portions 24a and 24b and the associated protuberances 25a and 25b in that one or both of the end portions 24a and 24b must be considerably elastically deformed relative to the other before both of them can be introduced into the corresponding holes of the associated protuberances 25a and 25b. Now, the same amount of deformation and corresponding effort would be required for the withdrawal of the end portions 24a and 24b (simultaneously or one after the other) from such holes in the protuberances 25a and 25b. This, in turn, means that the support member or wire 12 is able to support a rather substantial weight on the flame-like structure 10 being utilized pulled out of one or both of the aforementioned holes.

This feature of the present invention is being utilized, as mentioned before, for supporting a pair of eyeglasses while not being used at a location within easy reach of the user, being situated at the lapel of a man's jacket or at a similar location of a woman's or, for that matter of a different man's, outer garment. Basically, in order to cause the eyeglasses to be supported on the wire member 12, one of the earpieces of such eyeglasses is made to pass through the loop formed by the wire member 12, usually from the front to the back of the garment pin 10 that at that time is already secured to the aforementioned outer garment, and the eyeglasses are allowed to sink or descend, with the one earpiece in its folded condition behind the wire member 12, and with the main portion of the eyeglasses and the other earpiece, which is folded flat against such main frame portion, passing in front of the wire member 12, until the wire member 12 is nestled or seated in a junction region between the one earpiece and the main frame portion of the eyeglasses.

In this context, it is important, if not imperative, to assure that the eyeglasses will not wobble or swing excessively or violently while being supported in this condition on the selected part of the outer garment of the user, even as the user's body moves as he or she walks, bends down, turns around, moves his or her torso from front to back or from side to side, or conducts other similar movements in the course of normal activities. This requirement would not be fulfilled to satisfaction if the wire member 12 had a strictly or at least approximately U-shaped configuration, nor if it had a basically V-shaped configuration.

In the first instance, the aforementioned junction region of juncture between the one earpiece and the main portion of the eyeglasses would be able to slide along the arcuate bottom portion of the U-shaped wire member 12, which would be the equivalent of swinging about a center coinciding with the center of curvature of such arcuate portion. In the second case, there would be no sliding along the flanks of the V, but there would be swinging of the eyeglasses about the bottom center point of the juncture.

Both of these possibilities are avoided by adopting the unique design of the wire member 12 that is proposed by the present invention, that is one where the quite steep diverging end portions 24a and 24b merge at their lower zones with transition portions 26a and 26b exhibiting significantly lesser slopes than the end portions 24a and 24b, and such transition portions are, in turn, interconnected by a relatively short arcuate connecting portion 27. This particular configuration assures that, while there may occur some swinging of the eyeglasses in response to the body movements of the user, such swinging can never become too pronounced because of the constantly changing center of gravity of such swinging portion.

More particularly, when the aforementioned juncture embraces the connecting portion 27, there may occur some sliding (relatively slight due to the short length of such portion) and accompanying swinging of the eyeglasses about the center of curvature of the arcuate portion 27. However, once the juncture region of the eyeglasses reaches the region of merger of the connecting portion 27 with the respective transition portion 26a or 26b, the center of the swinging motion of the eyeglasses is transferred, almost instantly, to the lower region of the juncture region. It is to be realized in this connection that an occasional or even regular swinging motion of the eyeglasses is neither dangerous nor bothersome. What is to be avoided, though, is the possibility of sympathetic oscillation or swinging of the eyeglasses in concert with the body movements of the user, in that it can get rapidly out of hand.

And this is precisely what the special configuration of the wire member 12 proposed by the present invention avoids by causing the center of the swinging motion of the eyeglasses, and hence their natural resonance frequency about such center, to change from time to time in the course of each substantial swing in one direction or another, causing the swinging motion of the eyeglasses, to get out of phase with the body movements of the user in response to such center of oscillatory motion change, if in synchronism with such body movements before, or even prevent such swinging motion to get into synchronism with such body movements to begin with. In any event, the out-of-phase character of the swinging motion of the eyeglasses with respect to the periodic body movements of the user results in desirable damping of such swinging movement of the eyeglasses.

It will be understood that each of the elements described above, or two or more together, may also find a useful application in other types of constructions differing from the type described above. For example, a decorative three-dimensional figurine, such as a guardian angel, or symbols of love and affection, such as hearts, can be integrally molded on the outer thee of the frame-like structure 13, thereby additionally drawing one's attention and gaze to the image 16 on display.

While the present invention has been described and illustrated herein as embodied in a specific construction of a garment pin designed to carry an object to be displayed as well as temporarily supporting a pair of eyeglasses while not being used, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A garment pin for supporting a pair of eyeglasses at a predetermined location of an outer garment of a user, comprising:

a) a holding member;

b) means for detachably securing said holding member to the outer garment at the predetermined location thereof and having an upper and a lower region as considered in a use position of said holding member; and c) means for supporting the eyeglasses in a suspended position thereof on said holding member, including a loop-shaped support member secured to said holding member at said lower region thereof and extending in a downward direction therefrom away from said upper region as considered in said use position along a course including a pair of substantially straight end sections diverging from one another in an upward direction opposite to said downward direction, and an intermediate section integrally merging with said diverging end sections and including a substantially centrally situated arcuate connecting section of a radius of curvature large enough for the eyeglasses, which extend through and embrace said loop-shaped support member in said suspended position thereof, to be able to slide along said connecting section until reaching a respective one of a pair of transition sections of said support member that flank said connecting section and at which said radius of curvature changes to an appreciable extent.

2. The garment pin as defined in claim 1, wherein each of said transition sections is substantially straight but exhibits a lesser slope than the respective adjacent one of said end sections as considered in said use position of said holding member.

3. The garment pin as defined in claim 1, wherein said support member has a substantially wire-shaped configuration.

4. The garment pin as defined in claim 3, wherein said support member is separate from said holding member, and said holding member includes a pair of protuberances at said lower region thereof each substantially tightly embracing an associated one of said diverging end sections of said support member.

5. The garment pin as defined in claim 1, wherein said holding member includes a substantially frame-shaped structure bounding a display window an object, and means at the back of said holding member as considered in said use position thereof for maintaining said object to be displayed through said window in a display position thereof on said holding member.

6. The garment pin as defined in claim 5, wherein said object is substantially sheet-shaped and includes a circumferentially extending marginal portion; and wherein said frame-shaped structure includes a circumferentially extending recess for receiving said marginal portion of said object in said display position thereof.

7. The garment pin as defined in claim 6, wherein said object is a photograph carrying an image that is visible in said window in said display position of said object on said holding member.

8. The garment pin as defined in claim 5, wherein said maintaining means includes a plurality of substantially plate-shaped sections each rigid with said frame-shaped structure of said holding member and engaging said object in said display position thereof to confine said object between itself and said frame-shaped structure.

9. The garment pin as defined in claim 8, wherein said plate-shaped sections include a first section that is located substantially centrally on said frame-like structure at said lower region of said holding member, and a pair of second sections disposed on said frame-shaped structure at respective lateral regions of said holding member as considered in said use position thereof.

10. The garment pin as defined in claim 9, wherein said securing means includes a safety-pin-like securing structure including two components each mounted on one of said plate-shaped second sections and engaging the respective other one of said two components in a closed condition of said securing structure.

* * * * *